US012454342B1

(12) United States Patent
Abellera et al.

(10) Patent No.: US 12,454,342 B1
(45) Date of Patent: Oct. 28, 2025

(54) ADAPTABLE THROTTLE UNITS FOR MARINE DRIVES AND METHODS FOR INSTALLING THEM

(71) Applicant: Brunswick Corporation, Mettawa, IL (US)

(72) Inventors: Ryan Abellera, Fond du Lac, WI (US); Todd Dannenberg, Fond du Lac, WI (US); Suresh Venigalla, Sun Prairie, WI (US); Bruce Heidel, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 505 days.

(21) Appl. No.: 17/985,452

(22) Filed: Nov. 11, 2022

(51) Int. Cl.
*B63H 21/21* (2006.01)
*B63H 25/02* (2006.01)

(52) U.S. Cl.
CPC ..... *B63H 21/213* (2013.01); *B63H 25/02* (2013.01); *B63H 2021/216* (2013.01)

(58) Field of Classification Search
CPC . B63H 21/213; B63H 25/02; B63H 2021/216
See application file for complete search history.

(56) References Cited

U.S. PATENT DOCUMENTS 3,399,647 A * 9/1968 Alexander, Jr. ..... B63H 21/213 192/3.59
3,853,730 A 12/1974 Anderson
3,953,742 A 4/1976 Anderson et al.
4,213,353 A * 7/1980 Floeter ..... B63H 21/213 477/113
4,322,633 A 3/1982 Staerzl
4,492,877 A 1/1985 Staerzl
4,528,460 A 7/1985 Staerzl
(Continued)

FOREIGN PATENT DOCUMENTS

| | | |
|---|---|---|
| CA | 1040134 | 10/1978 |
| CA | 1056766 | 6/1979 |
| GB | 2133592 | 8/1986 |

OTHER PUBLICATIONS

Sawyer et al., Unpublished U.S. Appl. No. 17/469,479, filed Sep. 8, 2021.

(Continued)

*Primary Examiner* — Marc Burgess
(74) *Attorney, Agent, or Firm* — Andrus Intellectual Property Law, LLP

(57) ABSTRACT

An adaptable throttle unit for controlling a marine drive. A housing having first and second sides is coupleable to a marine vessel in a first orientation with the first side above the second side and in a second orientation with the first side below the second side. A throttle lever is configured to be rotatably coupled at an end to the housing such that a handle is above the end both when the housing is in the first orientation and in the second orientation. A sensor measures rotation of the throttle lever. A controller requests forward propulsion of the marine drive when the sensor measures rotation of the throttle lever in a first direction and the housing is in the first orientation, and alternately reverse propulsion when the sensor measures rotation of the throttle lever in the first direction when the housing is in the second orientation.

16 Claims, 11 Drawing Sheets

(56) References Cited

U.S. PATENT DOCUMENTS

| | | | | |
|---|---|---|---|---|
| 4,632,487 | A | 12/1986 | Wargula | |
| 4,648,497 | A * | 3/1987 | Prince | B63H 21/213 477/181 |
| 4,897,059 | A | 1/1990 | Newman | |
| 4,916,983 | A * | 4/1990 | Amrein | B60K 26/04 74/483 R |
| 5,747,892 | A | 5/1998 | Staerzl | |
| 5,840,164 | A | 11/1998 | Staerzl | |
| 5,967,867 | A * | 10/1999 | Rinzaki | B63H 21/213 74/480 B |
| 6,183,625 | B1 | 2/2001 | Staerzl | |
| 6,209,472 | B1 | 4/2001 | Staerzl | |
| 6,547,952 | B1 | 4/2003 | Staerzl | |
| 6,559,660 | B1 | 5/2003 | Staerzl | |
| 6,822,462 | B1 | 11/2004 | Staerzl | |
| 6,913,498 | B1 | 7/2005 | Sheth | |
| 7,064,459 | B1 | 6/2006 | Staerzl | |
| 7,112,107 | B1 | 9/2006 | Torgerud | |
| 7,131,877 | B1 | 11/2006 | Staerzl | |
| 7,305,928 | B2 | 12/2007 | Bradley et al. | |
| 7,381,312 | B1 | 6/2008 | Misorski et al. | |
| 7,387,553 | B1 | 6/2008 | Misorski et al. | |
| 8,118,983 | B1 | 2/2012 | Anderson et al. | |
| 8,372,260 | B1 | 2/2013 | Staerzl et al. | |
| 8,925,414 | B1 | 1/2015 | Park et al. | |
| 9,039,468 | B1 | 5/2015 | Arbuckle et al. | |
| 9,168,979 | B1 | 10/2015 | Schueller et al. | |
| 9,359,057 | B1 | 6/2016 | Andrasko et al. | |
| 9,446,828 | B1 | 9/2016 | Groeschel et al. | |
| 9,446,832 | B2 * | 9/2016 | Guglielmo | B63H 21/213 |
| 9,454,175 | B2 * | 9/2016 | Ozaki | G05G 1/06 |
| 9,701,383 | B1 | 7/2017 | Stuber et al. | |
| 9,764,813 | B1 | 9/2017 | Zarembka et al. | |
| 9,896,178 | B1 | 2/2018 | Przybyl et al. | |
| 9,963,213 | B1 | 5/2018 | Jaszewski et al. | |
| 10,246,173 | B1 | 4/2019 | Ingebritson | |
| 10,696,367 | B1 | 6/2020 | Ingebritson et al. | |
| 10,787,236 | B1 | 9/2020 | Erickson et al. | |
| 11,097,826 | B1 | 8/2021 | Dannenberg et al. | |
| 11,186,352 | B1 | 11/2021 | Erickson et al. | |
| 2018/0107236 | A1 * | 4/2018 | Weigand | A01B 71/02 |
| 2022/0212767 | A1 * | 7/2022 | Kimpara | G05G 5/06 |

OTHER PUBLICATIONS

Fergus et al., Unpublished U.S. Appl. No. 17/487,116, filed Sep. 28, 2021.

Schrank et al., Unpublished U.S. Appl. No. 17/509,739, filed Oct. 25, 2021.

Jaszewski, et al., Unpublished U.S. Appl. No. 17/550,463, filed Dec. 14, 2021.

Dannenberg, et al., Unpublished U.S. Appl. No. 17/554,540, filed Dec. 17, 2021.

Jaszewski, et al., Unpublished U.S. Appl. No. 17/585,214, filed Jan. 26, 2022.

Waldvogel, et al., Unpublished U.S. Appl. No. 17/671,041, filed Feb. 14, 2022.

Declaration of Prior Art signed by inventor Benjamin C. Wald on Sep. 2, 2022.

* cited by examiner

ADAPTABLE THROTTLE UNITS FOR MARINE DRIVES AND METHODS FOR INSTALLING THEM

FIELD

The present disclosure generally relates to adaptable throttle units for controlling marine drives and methods for installing adaptable throttle units for controlling marine drives on marine vessels.

BACKGROUND

The following U.S. Patents provide background information and are incorporated by reference in entirety.

U.S. Pat. No. 7,112,107 discloses a haptic throttle control mechanism that includes a vibrating element connected in vibration transmitting relation with the control mechanism. The vibrating element can be a motor with an eccentric weight attached to its shaft or a piezoceramic component. The vibrating signal can be used to provide information to the operator of the marine vessel relating to the actual operating speed of the engine or, alternatively, it can be used to alert the operator of an alarm condition.

U.S. Pat. No. 8,925,414 discloses a device for inputting command signals to a marine vessel control system, which includes a lever that is selectively operable in a joystick mode and a lever mode. In the lever mode, the lever is confined to pivoting about a horizontal axis to thereby input throttle and shift commands to the control system.

U.S. Pat. No. 9,039,468 discloses a system that controls speed of a marine vessel that includes first and second propulsion devices that produce first and second thrusts to propel the marine vessel. A control circuit controls orientation of the propulsion devices between an aligned position in which the thrusts are parallel and an unaligned position in which the thrusts are non-parallel. A first user input device is moveable between a neutral position and a non-neutral detent position. When the first user input device is in the detent position and the propulsion devices are in the aligned position, the thrusts propel the marine vessel in a desired direction at a first speed.

U.S. Pat. No. 9,359,057 discloses a system for controlling movement of a plurality of drive units on a marine vessel that has a control circuit communicatively connected to each drive unit.

U.S. Pat. No. 9,896,178 discloses method of controlling engine RPM in a marine propulsion device having an engine that effectuates rotation of a propulsor through a gear system that shifts amongst a forward gear position, a reverse gear position, and a neutral position, includes determining that a coolant temperature is below a temperature threshold or that a battery voltage is below a voltage threshold, and then increasing an engine RPM setpoint by a compensation RPM amount while the engines remains in an idle state in order to increase the coolant temperature or the battery voltage. When a shift instruction is detected to transition the gear system from the reverse gear position to the neutral position or from the forward gear position to the neutral position, the engine RPM setpoint is reduced by a shift RPM reduction amount during transition of the gear system, and the engine is controlled according to the engine RPM setpoint.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One aspect of the present disclosure generally relates to an adaptable throttle unit for controlling a marine drive of a marine vessel. The adaptable throttle unit includes a housing having a first side and an opposite second side. The housing is coupleable to the marine vessel in a first orientation with the first side above the second side and in a second orientation with the first side below the second side. A throttle lever extends from a first end to an opposite second end with a handle at the first end. The throttle lever is configured to be rotatably coupled at the second end to the housing such that the handle is above the second end both when the housing is in the first orientation and in the second orientation. A sensor is configured to measure rotation of the throttle lever relative to the housing. A controller is operatively coupled to the sensor and is configured to request forward propulsion of the marine drive when the sensor measures rotation of the throttle lever in a first direction and the housing is in the first orientation, and alternately to request reverse propulsion of the marine drive when the sensor measures rotation of the throttle lever in the first direction when the housing is in the second orientation such that the adaptable throttle unit accommodates different configurations for the marine vessel.

In another aspect according to the present disclosure, the adaptable throttle unit further includes the throttle lever with an inside and an opposite outside each extending between the first end and the second end, each of the inside and the outside having an opening. The inside faces the housing and the outside faces away from the housing both when the housing is in the first orientation and in the second orientation. A first stop and a second stop prevent the throttle lever from rotating beyond a first angle in the first direction and a second angle and in the second direction, respectively, wherein the first angle is substantially equal to the second angle. A switch is configured to receive a user input for controlling a trim of the marine drive. The switch is configured to be coupled within the opening of the outside of the throttle lever when the housing is in the first orientation, and the opening of the inside of the throttle lever when the housing is in the second orientation. A cover is configured to cover the opening of the inside of the throttle lever when the housing is in the first orientation and alternately to cover the opening of the outside of the throttle lever when the housing is in the second orientation.

Another aspect of the present disclosure generally relates to a method for installing a throttle unit for controlling a marine drive in a marine vessel. The method includes determining whether to couple a housing of the throttle unit to the marine in a first orientation or in a second orientation. The housing is coupled to the marine vessel with a first side of the housing above an opposite second side of the housing when coupling the housing in the first orientation and alternately with the first side below the second side in the second orientation. The method further includes rotatably coupling a throttle lever to the drive housing such that a first end of the throttle lever having a handle is above an opposite second end of the throttle lever both when the housing is in the first orientation and when the housing is in the second orientation. A sensor is positioned so as to measure rotation of the throttle lever relative to the housing. The sensor is operatively coupled to a controller. The controller is configured to request forward propulsion of the marine drive when the sensor measures rotation of the throttle lever in a first direction and the housing is in the first orientation, and to request reverse propulsion of the marine drive when the sensor measures rotation of the throttle lever in the first direction when the housing is in the second orientation such that the adaptable throttle unit accommodates different configurations for the marine vessel.

DETAILED DISCLOSURE

In the present description, certain terms have been used for brevity, clarity, and understanding. No unnecessary limitations are to be implied therefrom beyond the requirement of the prior art because such terms are used for descriptive purposes only and are intended to be broadly construed. The different systems and methods described herein may be used alone or in combination with other systems and methods. Various equivalents, alternatives, and modifications are possible.

Figure 1:
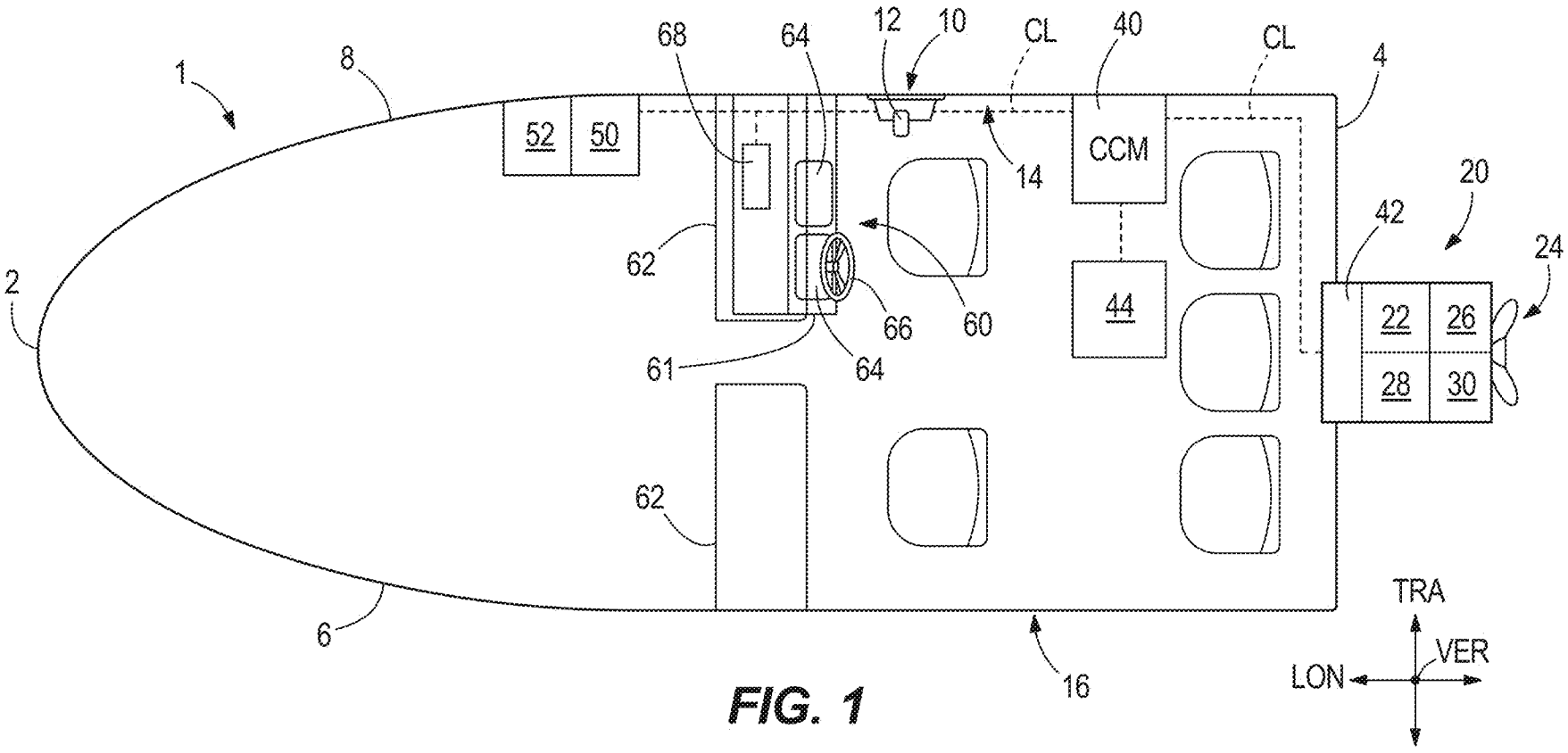
FIG. 1 is a top view of an adaptable throttle unit installed according to the present disclosure in a marine vessel in a first orientation.

FIG. 1 shows an adaptable throttle unit 10 according to the present disclosure installed in a marine vessel 1, which is used for controlling at least one marine drive 20 configured to propel the marine vessel 1 through the water. The marine vessel 1 extends between a bow 2 and a stern 4 along a longitudinal axis LON, and between a port side 6 and a starboard side 8 along a transverse axis TRA perpendicular to the longitudinal direction LON (each also being perpendicular to a vertical axis VER). The marine vessel 1 is propelled through the water by the marine drives 20, which while shown as an outboard motor could instead be one or more inboard motors, stern drives, pod drives, jet drives, and/or the like. The marine drive 20 includes a powerhead 22. The powerhead 22 may be internal combustion engines (e.g., gasoline or diesel engines), one or more electric motors, a hybrid thereof, and/or the like. The marine drive 20 includes a propeller 24 coupled in torque-transmitting relationship with a respective powerhead 22 so as to generate propulsion in the water.

The adaptable throttle unit 10 has a throttle lever 12 that is operable to control the marine drive 20, including providing thrust commands to the central control module 40. The thrust commands include both a magnitude and a direction of thrust (e.g., forward thrust, and reverse thrust corresponding to propelling the marine vessel forwardly and aftwardly). By way of example, rotating the throttle lever 12 in a first or forward direction away from its neutral, detent position could be interpreted as a value from 0% to 100% operator demand corresponding via an input/output map, such as a look up table, to a position of the throttle valves and/or request a particular output by an electric motor of the powerheads 22. The input/output map might dictate that the throttle valves are fully closed when the throttle lever 12 is in a first detent position (i.e., 0% demand), and are fully open when the throttle lever 12 is pushed forward to its furthest extent (i.e., 100% demand). As discussed further below, similar methods may also be employed for controlling steering, whereby operator inputs are received from a range of-100% to +100% corresponding to full port and full starboard steering directions, which then cause corresponding steering of the marine drives 20, such as by using a lookup table. The adaptable throttle unit 10 may control the marine drive 20 via cables or a "throttle by wire" system in a manner known in the art.

The marine drives 20 further include powerhead speed sensors 26 measuring a speed of a respective powerhead 22 (or an output shaft thereof). The powerhead speed sensors 26 may be shaft rotational speed sensors (e.g., Hall-Effect sensors) that measure a speed of the powerhead 22 in rotations per minute (RPM) in a manner known in the art.

The marine drive 20 is further provided with a steering actuator 28 configured to steer the marine drives 20, respectively, in accordance with commands from a steering device as discussed further below. The steering actuators 28 may operate as a "steer by wire" system rather than including physical linkages between the marine drives 20 and steering input devices (e.g., a steering wheel). The steering actuators 28 include steering angle sensors therein, which provide feedback regarding the steering angle of the corresponding marine drive 20 in a manner known in the art. The steering actuators 28 may be hydraulically, pneumatically, and/or electromechanically operated. Additional information regarding exemplary steering actuators is provided in U.S. Pat. Nos. 7,150,664; 7,255,616; and 7,467,595, which are incorporated by reference herein.

Similarly, each marine drive 20 is provided with a trim actuator 30 configured to adjust the trim angle of these devices in a manner known in the art. The trim actuators 30 include steering angle sensors that provide feedback regarding the trim angle of the corresponding marine drive 20 in a manner known in the art. The trim actuators 30 may be hydraulically, pneumatically, and/or electromechanically operated. Additional information regarding exemplary trim actuators is provided in U.S. Pat. Nos. 6,583,728; 7,156,709; 7,416,456; and 9,359,057, which are incorporated by reference herein.

With continued reference to FIG. 1, a central control module 40 (or CCM) is provided in signal communication with the powerheads 22, as well as being in signal communication with the associated sensors and other components noted herein below. In certain examples, the central control module 40 communicates with propulsion control modules 42 (or PCMs) and/or other control devices associated with each of the marine drives 20 in a manner known in the art. Although FIG. 1 shows one central control module 40, it should be recognized that more than one central control module may work together serially and/or in parallel.

Referring to FIG. 1, power is provided to the marine vessel 1 via a power system 44, which may include batteries and/or other energy storage systems known in the art. It should be recognized that the power system 44 may be located other than as shown in FIG. 1, such as being integral with the marine drive 20. The power system 44 provides power to the central control module 40 and propulsion control modules 42, as well as to other components associated with the marine drives 20 or marine vessel 1 more generally, as discussed further below. One such additional component powered by the power system 44 is a global positioning system (GPS) 50 that provides location and speed of the marine vessel 1 to the central control module 40. Additionally, or alternatively, a vessel speed sensor such as a Pitot tube or a paddle wheel could be provided to detect the speed of the marine vessel 1. The marine vessel 1 may also include an inertial measurement unit (IMU) or an attitude and heading reference system (AHRS) (collectively shown as the IMU/AHRS 52). An IMU has a solid state, rate gyro electronic compass that indicates the vessel heading and solid-state accelerometers and angular rate sensors that sense the vessel's attitude and rate of turn. An AHRS provides 3D orientation of the marine vessel 1 by integrating gyroscopic measurements, accelerometer data, and magnetometer data. The IMU/AHRS 52 could be GPS-enabled in place of a separate GPS 50.

With continued reference to FIG. 1. the marine vessel 1 includes a helm 60 having various displays, gauges, and ignition switches, as well as one or more operator input devices for controlling various functions of the marine drive 20 and the marine vessel 1 more generally. One such operator input device is the adaptable throttle unit 10. The adaptable throttle unit 10 is shown in FIG. 1 in a first configuration in which is it coupled to an inward-facing wall 14 of the hull 16 (here on the starboard side 8, thereby being operable via the right hand). The first configuration is also referred to as being "panel mounted" and being coupled to the marine vessel in a "first orientation."

The helm 60 is protected behind a windshield 62. The operator input devices further include a multi-functional display device 64 with a user interface, which may be an interactive, touch-capable display screen, a keypad, a display screen and keypad combination, a track ball and display screen combination, and/or any other type of user interface known in the art. The multi-functional display devices 64 may be used to display menus and settings for configuring other display devices according to the present disclosure, as discussed below. Additional operator input devices include one or more steering devices, such as a steering wheel 66 and/or a joystick, configured to facilitate user input (e.g., via the central control module 40, the propulsion control modules 42, and/or a helm control module 68 in a manner known in the art) for steering the marine vessel 1.

Figure 2:
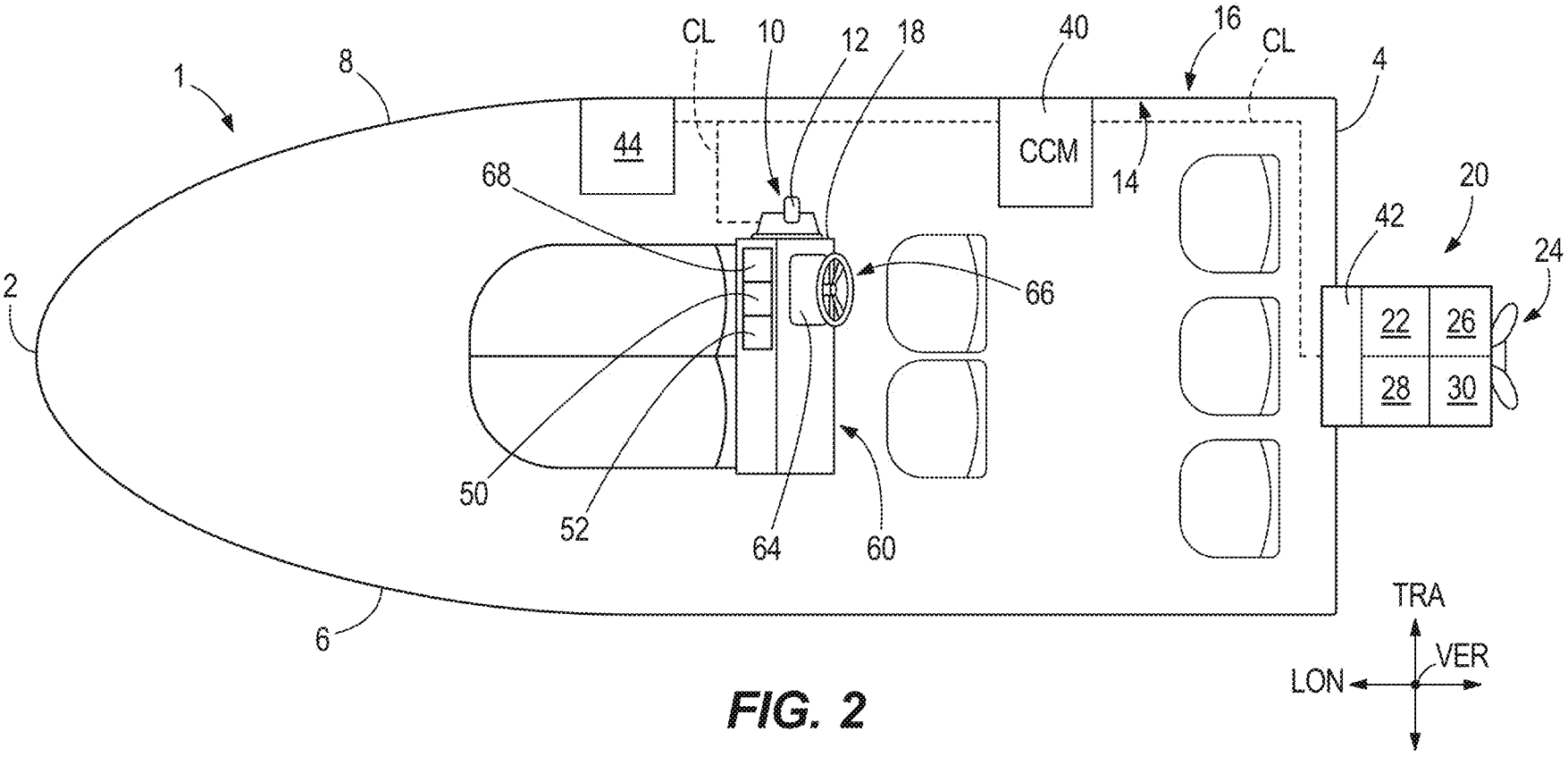
FIG. 2 is a top view of the adaptable throttle unit of FIG. 1 installed in a second orientation.

FIG. 2 shows an alternate configuration of a marine vessel 1, which in this case has a center console as the helm 60, rather than the helm 60 being against one of the inward-facing walls 14 of the hull 16. The adaptable throttle unit 10 is again provided at the helm 60 to provide the same controls discussed above. The adaptable throttle unit 10 of FIG. 2 is now shown in a second configuration in which it is coupled to an outer-facing wall 18 of the center console or helm 60. The outer-facing wall 18 is inward within the marine vessel 1 from the inward-facing walls 14 of the hull 16. The second configuration is also referred to as being "center console mounted" and being coupled to the marine vessel in a "second orientation." This is in contrast to the adaptable throttle unit 10 being coupled to the inward-facing wall 14 of the hull 16 as in the first configuration (FIG. 1). The adaptable throttle unit 10 is operable via the right hand in both the first configuration and the second configuration, as discussed further below.

Throttle controls known in the art are usable as either a panel mounted model or a center console mounted model but cannot work for both configurations. As such, the present inventors have recognized that boat builders must separately stock throttle controls for each configuration of marine vessel, which increases the necessary inventory (both cost and physical space). This burden is reduced by providing an adaptable throttle unit that can be adapted for use in either configuration as needed. Additionally, the cost of producing throttle controls is reduced by increasing the volume thereof (i.e., the total of all panel mount and center console mount units combined).

Additional information is now provided for such adaptable throttle units 10 according to the present disclosure, including how the same adaptable throttle units 10 are adaptable to be installed in the marine vessel 1 in either the first configuration or the second configuration shown in FIGS. 1 and 2.

Figure 3:
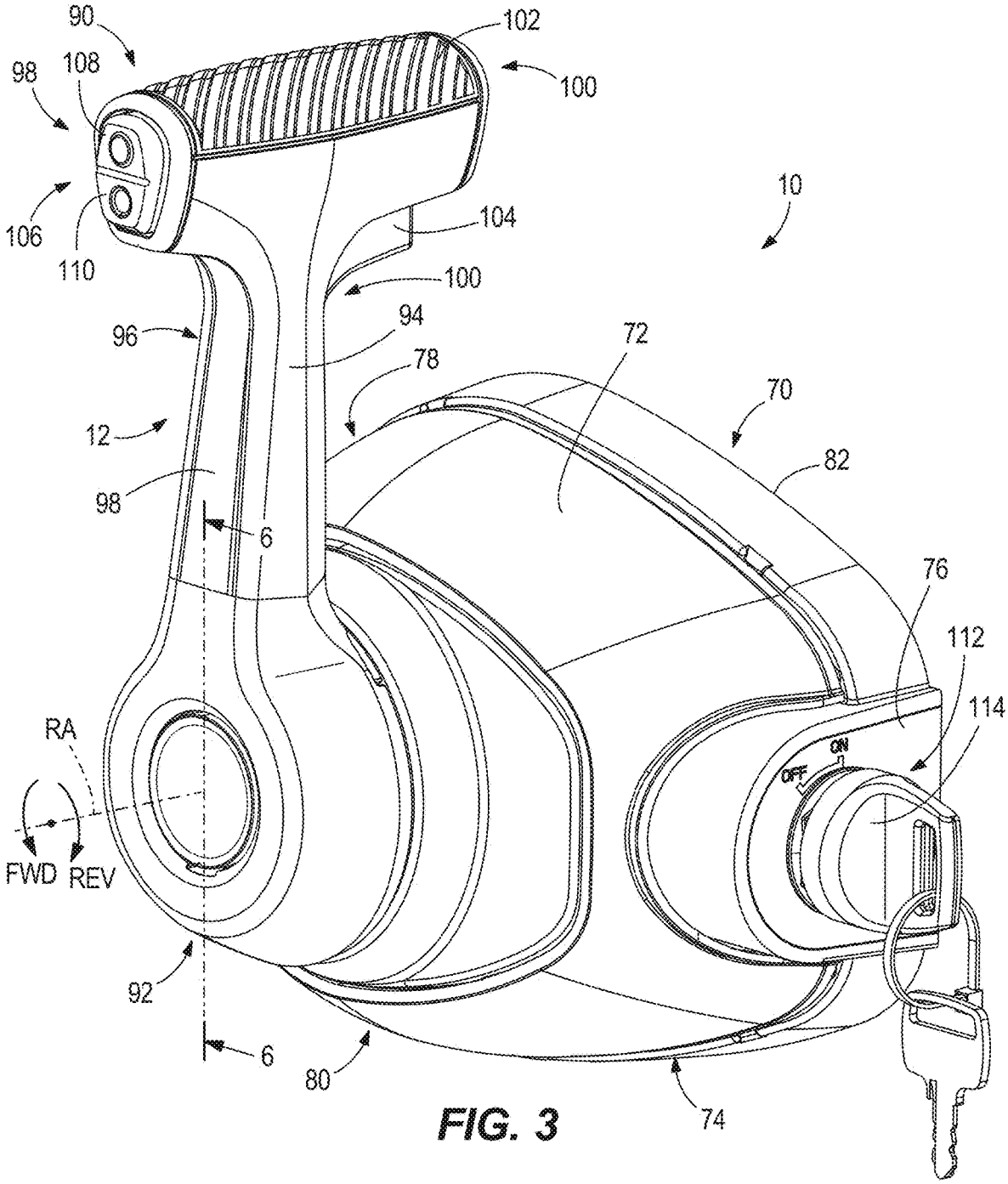
FIG. 3 is an isometric view of the adaptable throttle unit of FIG. 1 in the first orientation.

FIG. 3 shows an adaptable throttle unit 10 in a first configuration as shown in FIG. 1. The adaptable throttle unit 10 has a housing 70 with a first side 72 and an opposite second side 74, shown here facing upwardly and downwardly, respectively. A third side 76 and an opposite fourth side 78 each extend between the first side 72 and the second side 74, as do a fifth side 80 and an opposite sixth side 82. The housing 70 is configured to be coupled to the marine vessel in a conventional manner, such as via screws or other fasteners coupling the sixth side 82 of the housing 70 to the marine vessel. When the adaptable throttle unit 10 is coupled to the marine vessel 1 in the first orientation, here on an inwardly facing wall 14 of the hull 16 (see FIG. 1), the first side 72 faces upwardly and the second side 74 faces downwardly. In other words, the first side 72 is above the second side 74. As will become apparent, the orientations of the first side 72 and the second side 74 relative to each other are not fixed, but effectively reverse between the first configuration of FIG. 1 and the second configuration of FIG. 2 (e.g., the housing rotating 180 degrees).

With continued reference to FIG. 3, the adaptable throttle unit 10 further includes a throttle lever 12. The throttle lever 12 may have some common features with Mercury Marine handle assembly part number 8M0143208 available in the market. However, handle assemblies known in the art are not configured to be adaptable between first and second configurations and is instead limited to panel mounted uses only.

The throttle lever 12 extends from a first end 90 and an opposite second end 92, shown here facing upwardly and downwardly, respectively. A third end 94 and an opposite fourth end 96 each extending between the first end 90 and the second end 92, as do an inside 100 and an outside 98. The throttle lever 12 of FIG. 3 has a T-shaped handle 102 at the first end 90 with a grip for the operator to grasp during use. The second end 92 throttle lever 12 is coupled to the housing 70 so as to be rotatable about an axis RA. The first end 90 of the throttle lever 12 is above the second end 92 of the throttle lever 12 both when the housing 70 is installed in the marine vessel 1 in the first orientation (FIGS. 1 and 3), and when the housing 70 is installed in the second orientation (FIG. 2). Likewise, the inside 100 of the throttle lever 12 faces towards the housing 70 and the outside 98 of the throttle lever 12 faces away from the housing 70 in both the first orientation and in the second orientation.

Figure 4:
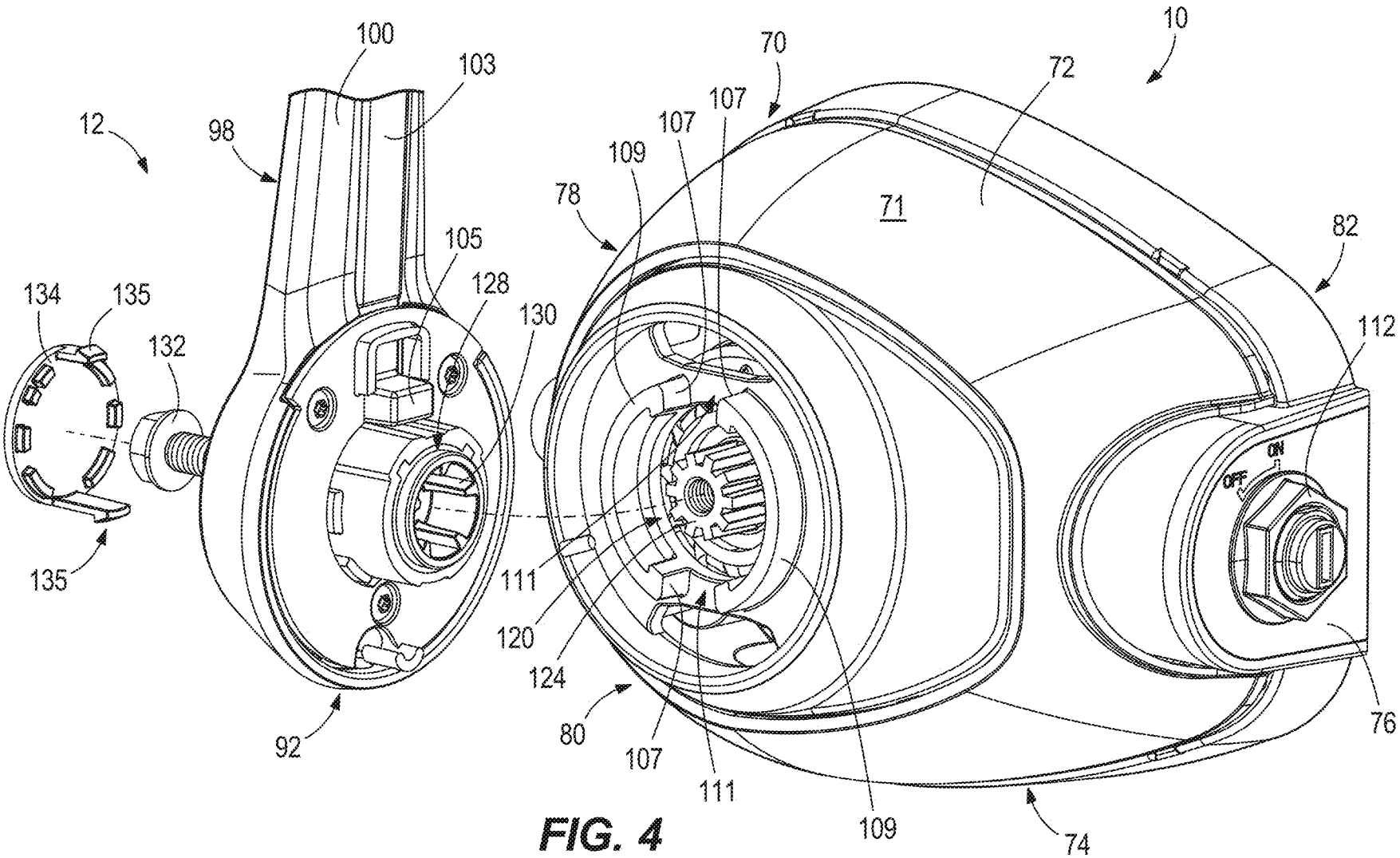
FIG. 4 depicts the adaptable throttle unit of FIG. 3 with a throttle lever removed.

As discussed further below, a release button 104 is also provided with the throttle lever 12. The release button 104 is provided on the inside 100 of the throttle lever 12 and is biased downwardly in a conventional manner, such as via springs. The release button 104 is actuated by squeezing (i.e., forcing upwardly) the fingers of the operator's right hand during use. With reference to FIG. 4, the release button is connected via a member 103 to a latch 105 (also referred to as a "lock"), whereby forcing the release button upwardly also moves the latch 105 upwardly. When the latch 105 is not released (i.e., is not forced upwardly), it is sandwiched between end stops 107 of two arcs 109 that extend from the fifth side 80 of the housing 70. This engagement prevents rotation of the throttle lever 12 relative to the housing 70. Two arcs 109 are provided so that there are two gaps 111 formed between the end stops 107 thereof. The two gaps 111 allow the throttle lever 12 to be coupled to the housing 70 in both the first orientation and the second orientation as presently disclosed. In this manner, releasing the latch 105 allows the throttle lever 12 to be rotated out of the neutral position (FIG. 3) in either direction in either the first orientation or the second orientation of the housing 70 being coupled to the marine vessel.

Returning to FIG. 3, a switch 106 is also provided on the handle 102 of the throttle lever 12, which here includes a first button 108 and a second button 110 that control the trim of the marine drive in a conventional manner. The first button 108 and the second button 110 are each momentary switches that are actuated by the right-hand of the operator forcing them inwardly towards the housing 70. A key switch 112 is also provided on the third side 76 of the housing 70, which controls whether the marine drive is operable based on a position of the key 114 in a conventional manner. In both the first orientation (FIG. 1) and the second orientation (FIG. 2), the key switch 112 faces aftwardly so as to face the operator.

Figure 5:
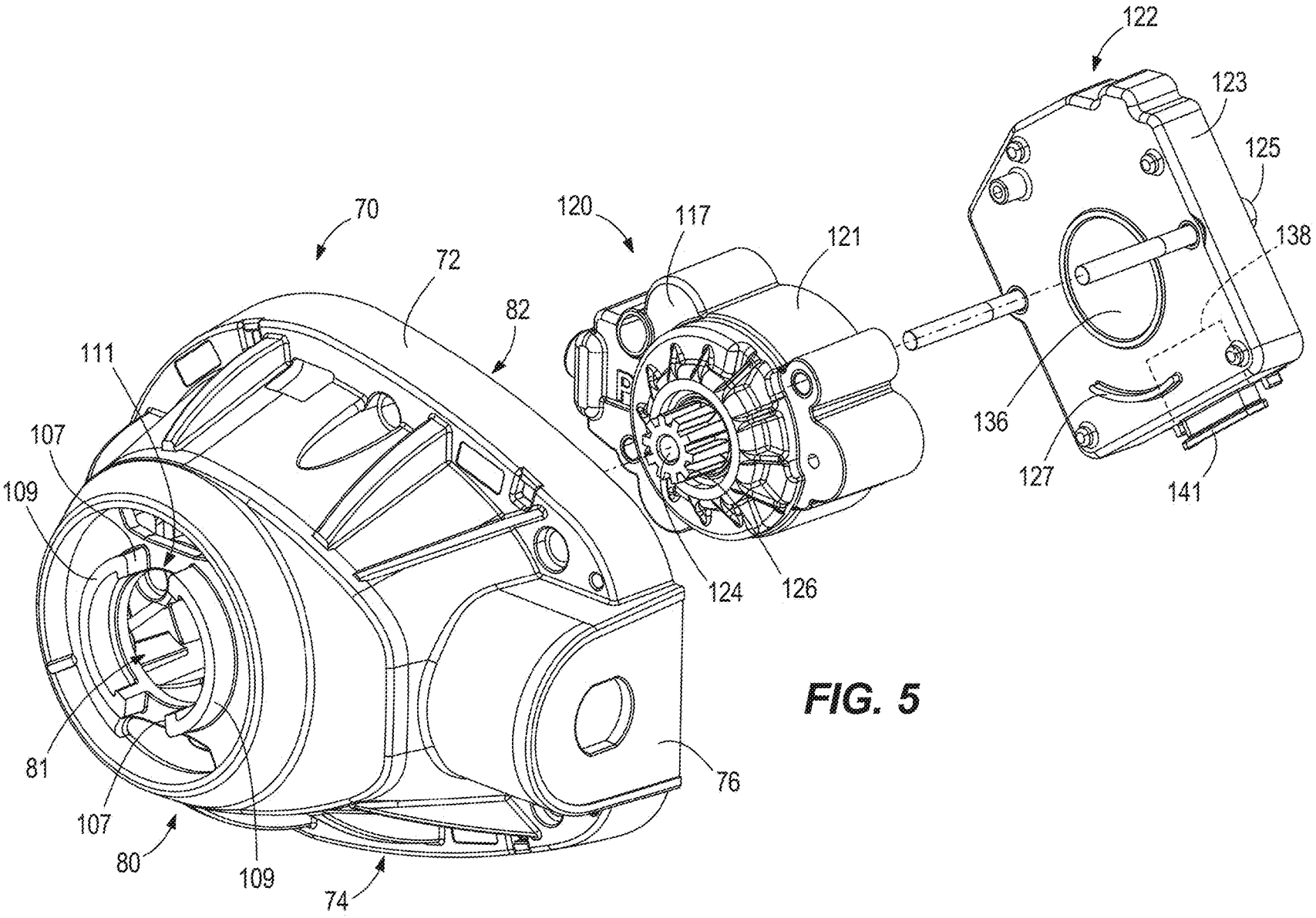
FIG. 5 is an exploded view of a housing from the adaptable throttle unit of FIG. 4.

FIGS. 4 and 5 show the throttle lever 12 of FIG. 3 removed from the housing 70, as well as the components within the housing 70. An external cover 71 of the housing 70 is shown removed in FIG. 5. Inside the housing 70 is a friction module 120 and a sensor assembly 122, also referred to in the art as a "center module". The friction module 120 and the sensor assembly 122 are each contained within housings 121, 123, respectively, that are coupled to the housing 70 of the adaptable throttle unit 10 in a conventional manner (e.g., fasteners 125 such as screws, bolts, rivets, or adhesives). Different features 127 are provided to properly align the housing 70, the friction module 120, and the sensor assembly 122. The friction module 120 may have common features with Mercury Marine friction module part number 8M0120443. However, friction modules known in the art are not configured to be adaptable between first and second configurations, and are instead limited to panel mounted uses only, as discussed further below. The center module may also have common features with Mercury Marine center module part number 8M0147224.

The friction module 120 includes an axle 124 with splines 126, which extends through an opening 81 in the fifth side 80 of the housing 70. The throttle lever 12 has an internal gear 128 on the inside 100 at the second end 92 thereof. The internal gear 128 has splines 130 that mesh with the splines 126 of the friction module 120 when the throttle lever 12 is coupled to the housing 70 (e.g., via a fastener 132 that is covered by a cap 134 with clips 135 in a conventional manner). In this manner, rotating the throttle lever 12 rotates the axle 124 of the friction module 120.

Figure 11:
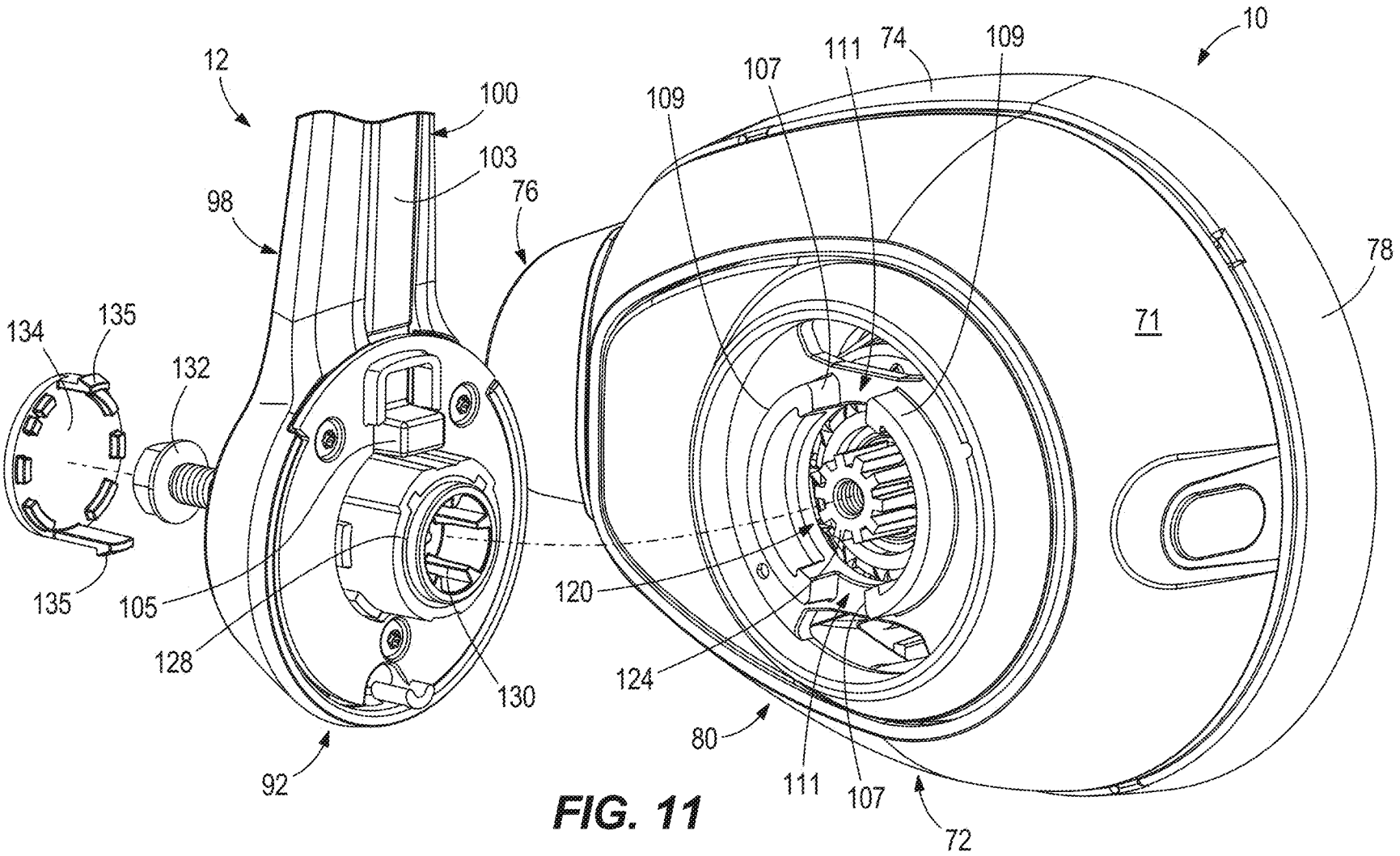
FIG. 11 is an isometric view of the adaptable throttle unit of FIG. 2 in the second orientation.

The adaptable throttle unit 10 is configured such that the throttle lever 12 may be coupled to the friction module 120 at different relative angles therebetween. In particular, the meshed coupling of the internal gear 128 of the throttle lever 12 and the axle 124 of the friction module 120 allows the throttle lever 12 to be vertically oriented both when coupling to the housing 70 in the first orientation as shown in FIG. 4 and when coupling to the housing 70 in the second orientation as shown in FIG. 11, without rotating the axle 124 relative to the housing 121 of the friction module 120.

Referring to FIGS. 4 and 5, the sensor assembly 122 includes a sensor 136 that measures the rotational angle of the axle 124 of the friction module 120. Therefore, the sensor 136 measure the position of the throttle lever 12. The sensor assembly 122 further includes a controller 138 that receives signals from the sensor 136 corresponding to the rotational position of the throttle lever 12. The controller 138 is electrically coupled to the central control module 40 (FIG. 1) or to the control system 300 (FIG. 12, discussed further below) more generally via a connector 141. The controller 138 is configured to request propulsion of the marine drive 20 (see FIG. 1) based on the rotational position sensed by the sensor 136. In the first configuration of the adaptable throttle unit 10 as shown in FIGS. 1 and 3, rotating the throttle lever 12 in a first direction from the neutral position (counterclockwise when looking at the outside 98 of the throttle lever 12) causes the controller 138 to request forward propulsion of the marine drive. Rotating the throttle lever 12 in an opposite second direction from neutral causes the controller 138 to request reverse propulsion of the marine drive. It should be recognized that the controller 138 may increase the requested thrust of the propulsor as the rotational angle of the throttle lever 12 sensed by the sensor 136 increases.

As is discussed further below, the controller 138 is configurable so as to request propulsion in the opposite direction when the adaptable throttle unit 10 is in the second orientation. In other words, rotating the throttle lever 12 in the first direction (counterclockwise looking at the outside 98 thereof) causes the controller 138 to request reverse propulsion, whereas rotating the throttle lever 12 in the second direction (clockwise looking at the outside 98 of the throttle lever 12) requests forward propulsion. In this manner, the controller 138 is configurable such that rotating the throttle lever 12 away from the user requests forward propulsion, whereby this rotational direction changes between the first orientation and the second orientation of installing the adaptable throttle unit 10.

Figure 6:
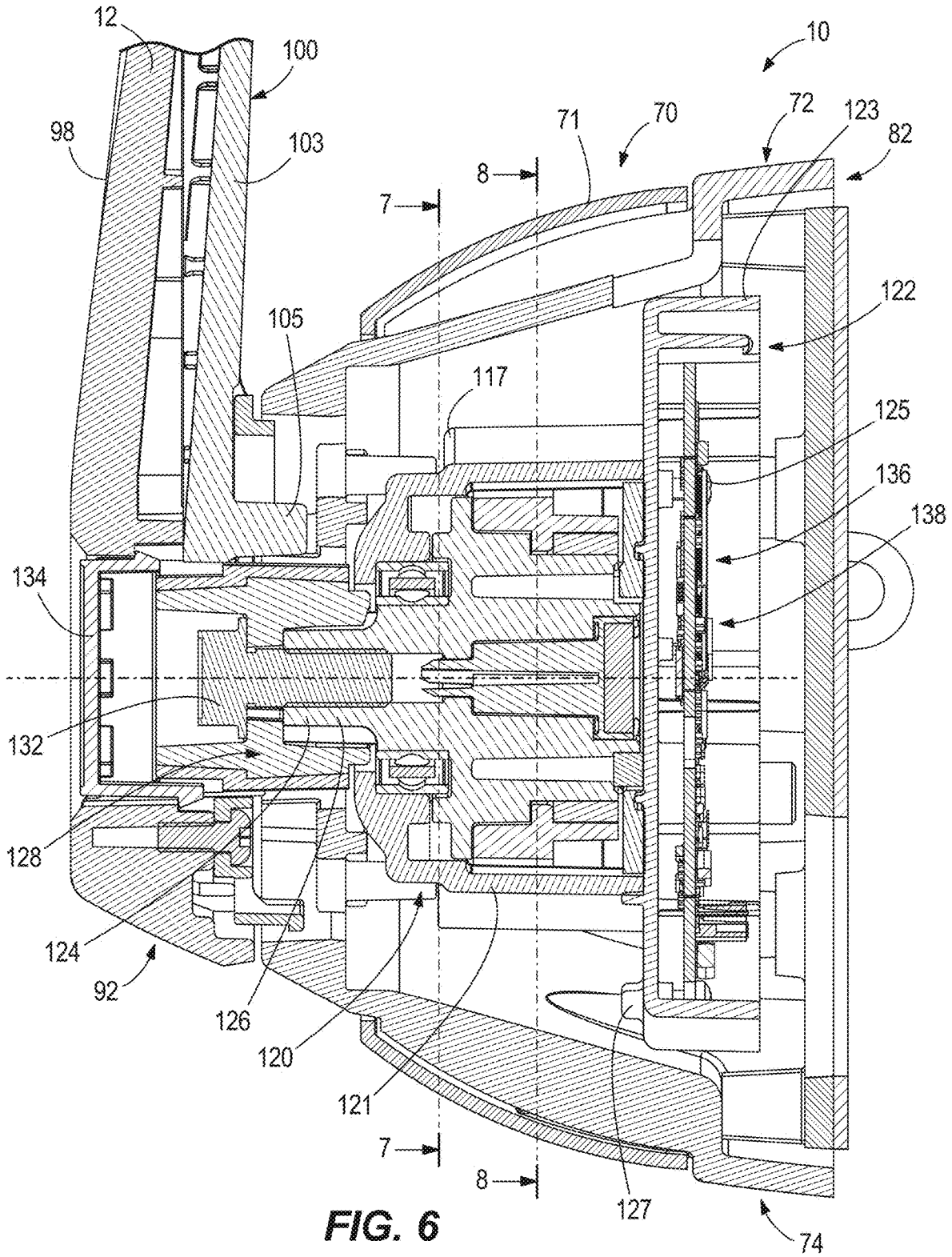
FIG. 6 is a sectional side view taken along the line 6-6 in FIG. 3.
Figure 7:
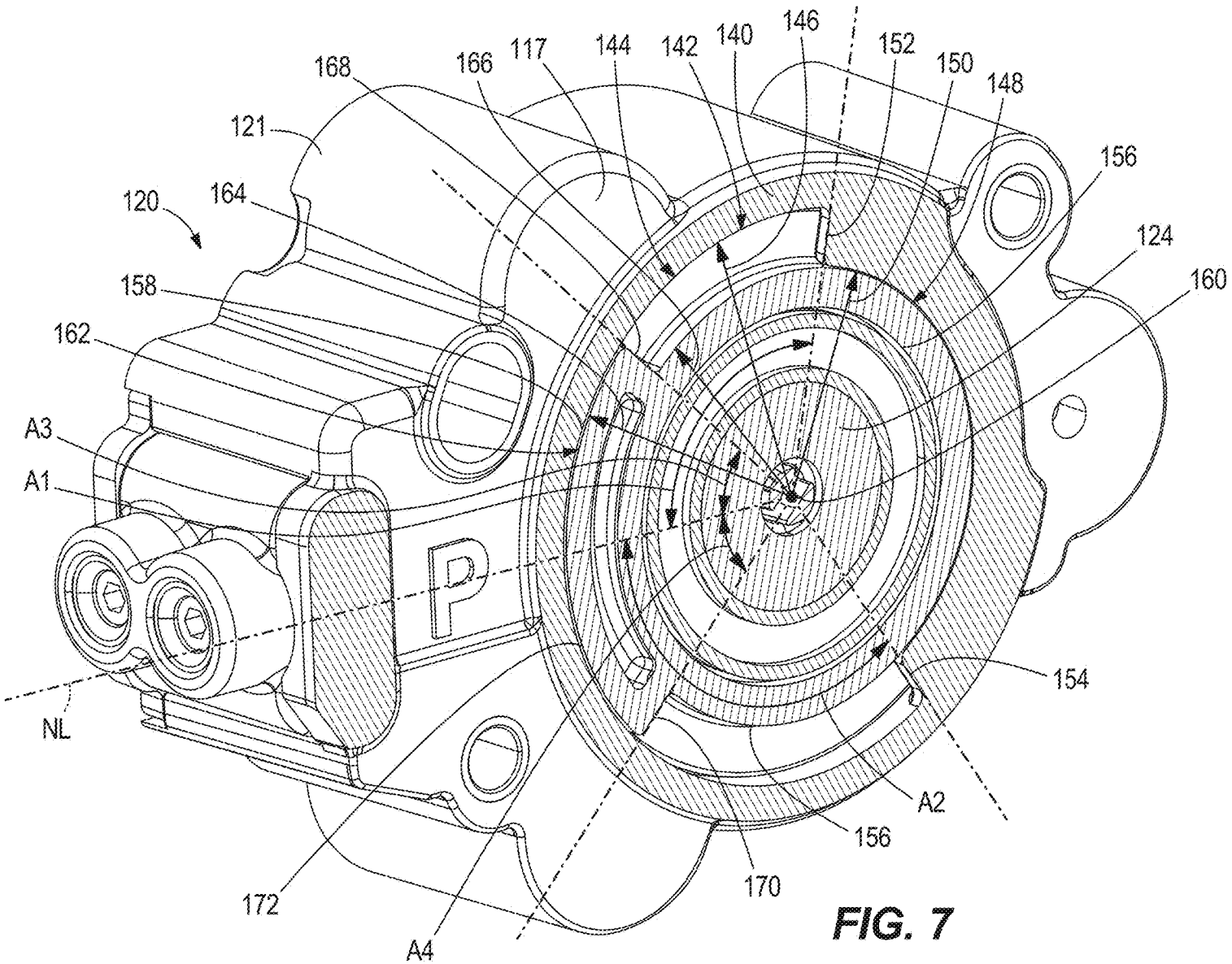
FIG. 7 is a sectional isometric view taken along the line 7-7 in FIG. 6.

FIG. 7 depicts a sectional view inside the friction module 120 of FIG. 6 from the front 117 taken along the line 7-7. The friction module 120 includes a fixed frame 140 within which the axle 124 rotates. An inside 142 of the fixed frame 140 forms a first arc 144 having a first radius 146 and a second arc 148 having a second radius 150 that is smaller than the first radius 146. A first shelf 152 and a second shelf 154 are formed at the transitions between the first arc 144 and the second arc 148 due to the differences in radii. It should be noted that shelves are also referred to herein as "stops."

The axle 124 has a cylindrical portion 156 and an extension 158 that extends radially away from a center 160 of the cylindrical portion 156, whereby the center 160 forms the rotational axis that the axle 124 rotates about. The extension 158 forms an arc 162 having a first radius 164 larger than a second radius 166 of the cylindrical portion 156. The first radius 164 of the arc 162 is approximately equal to the first radius 146 of the first arc 144 of the fixed frame 140 such that the extension 158 is at least nearly in contact with the first arc 144 inside the fixed frame 140 as the axle 124 is rotated via the throttle lever therein. A first shelf 168 and a second shelf 170 are formed at the transitions between the extension 158 and the cylindrical portion 156 due to the differences in radii. The arc 162 has an arc length 172 between the first shelf 168 and the second shelf 170.

The friction module 120 is configured such that when the axle 124 is in a rotational position associated with the marine drives being in the neutral position (as shown), neither forward nor reverse propulsion is requested. FIG. 7 shows a neutral line NL axially bisecting both the arc 162 of the extension 158 of the axle 124 and of the first arc 144 of the inside 142 of the fixed frame 140. In other words, a first angle A1 between the neutral line NL and the first shelf 152 of the fixed frame 140 is equal to a second angle A2 between the neutral line and the second shelf 154. Likewise, a third angle A3 between the neutral line NL and the first shelf 168 of the extension 158 is equal to a fourth angle A4 between the neutral line and the second shelf 170 (the axle 124 being shown in neutral).

This provides that the throttle lever 12 may be rotated the same angular distance from neutral in either direction before being stopped by engagement between the first shelf 152 and the first shelf 168 or between the second shelf 154 and the second shelf 170, for example being between 60 and 80 degrees both clockwise and counterclockwise. These angles may alternatively be between 50 and 60, between 60 and 70, between 70 and 80, or between 65 and 75 degrees, by way of example. The friction module 120 is therefore distinct from others presently known in the art, whereby the angle in which the throttle lever may be rotated in the forward direction is greater than the angle it may be rotated in the reverse direction. Since the presently disclosed adaptable throttle unit 10 may be installed in a marine vessel in the first orientation or the second orientation as discussed above, which changes which rotational direction corresponds to forward versus reverse, friction modules presently known in the art would not function in this adaptable manner.

It should be recognized that the adaptable throttle unit 10 presently disclosed does not require this feature of even angles of rotatability in each direction. Moreover, the angle by which the throttle lever 12 may be rotated before stopped by engagement between the shelves as discussed above, such as by changing the arc length 172 between the first shelf 168 and the second shelf 170 of the extension 158, and/or an arc length between the first shelf 152 and the second shelf 154 of the fixed frame 140.

Figure 8:
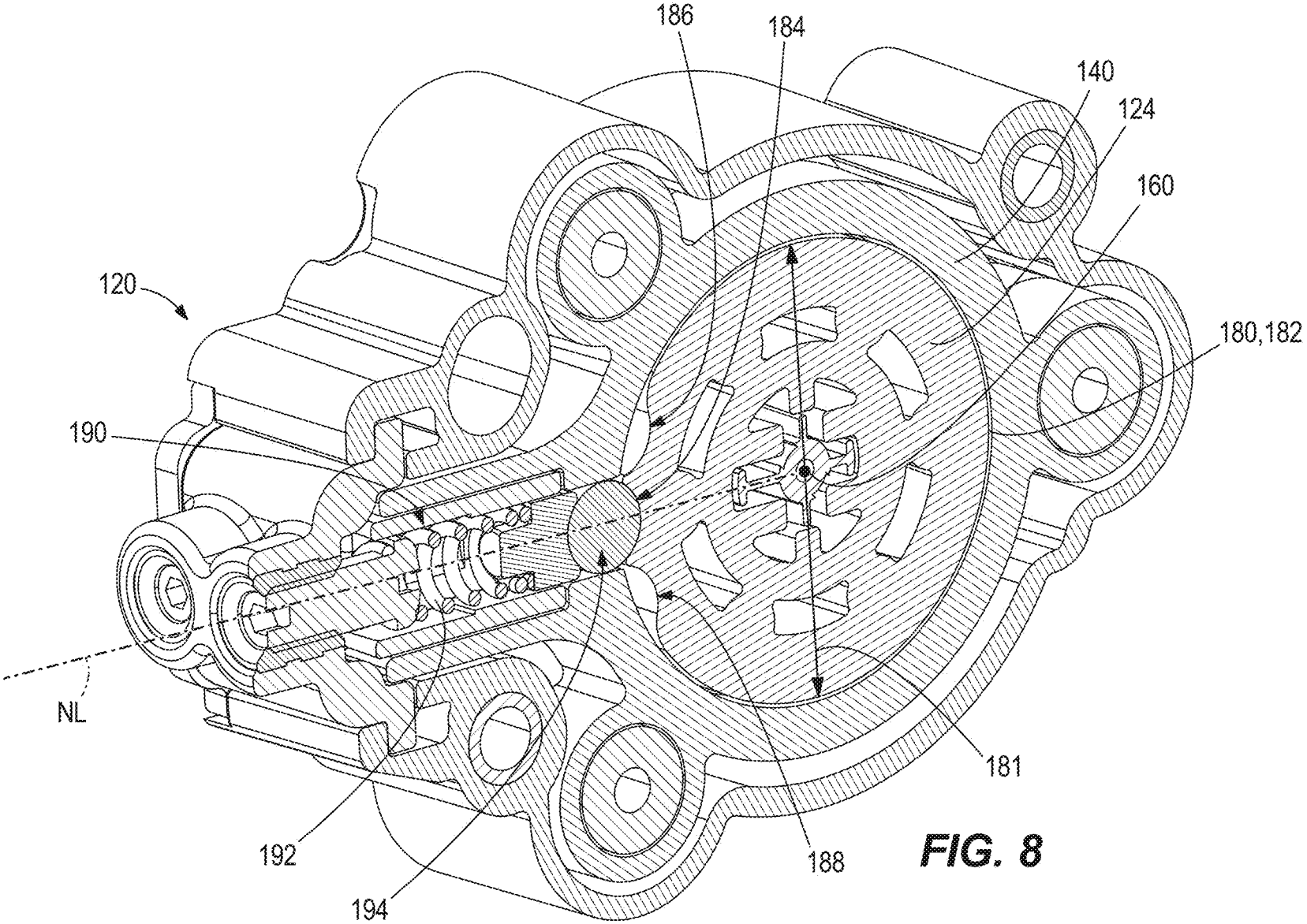
FIG. 8 is a sectional isometric view taken along the line 8-8 in FIG. 6.

FIG. 8 depicts FIG. 7 depicts a sectional view inside the friction module 120 of FIG. 6 from the front 117 taken along the line 8-8. The axle 124 of the friction module 120 is shown having an outer periphery 180 that is generally circular, having a substantially same diameter 181 as an inner periphery 182 of the fixed frame 140 so as to be rotatably supported therein. The outer periphery 180 of the axle 124 has a neutral detent position 184, a first idle detent position 186, and a second idle detent position 188. A detent 190 has a spring 192 that biases a ball 194 into engagement with the outer periphery 180 of the axle 124 in a conventional manner. This requires the operator to provide additional force to rotate the throttle lever such that the axle 124 rotates out of, or through, the neutral detent position 184, first idle detent position 186, and second idle detent position 188 in a conventional manner. The neutral detent position 184 corresponds to the neutral line NL discussed above with respect to FIG. 7. Therefore, the adaptable throttle unit 10 is configured such that the throttle lever 12 is rotatable an even angular amount on either side of the neutral detent position 184, thus allowing the adaptable throttle unit 10 to operate in the same manner in both the first orientation and the second orientation.

The present inventors have recognized that the switch 106 discussed above (e.g., trim control switches) must also be relocated to remain operable by the intended hand when transitioning between the first orientation and the second orientation of coupling the housing to the marine vessel. In particular, the adaptable throttle unit 10 is configured to be operable the right hand in either the first orientation or the second orientation, including the switch 106 being operable by the thumb of the right hand. Thus, the switch 106 is configured to be coupled to either the outside 98 or the inside 100 of the handle 102 of the throttle lever 12.

Figure 9:
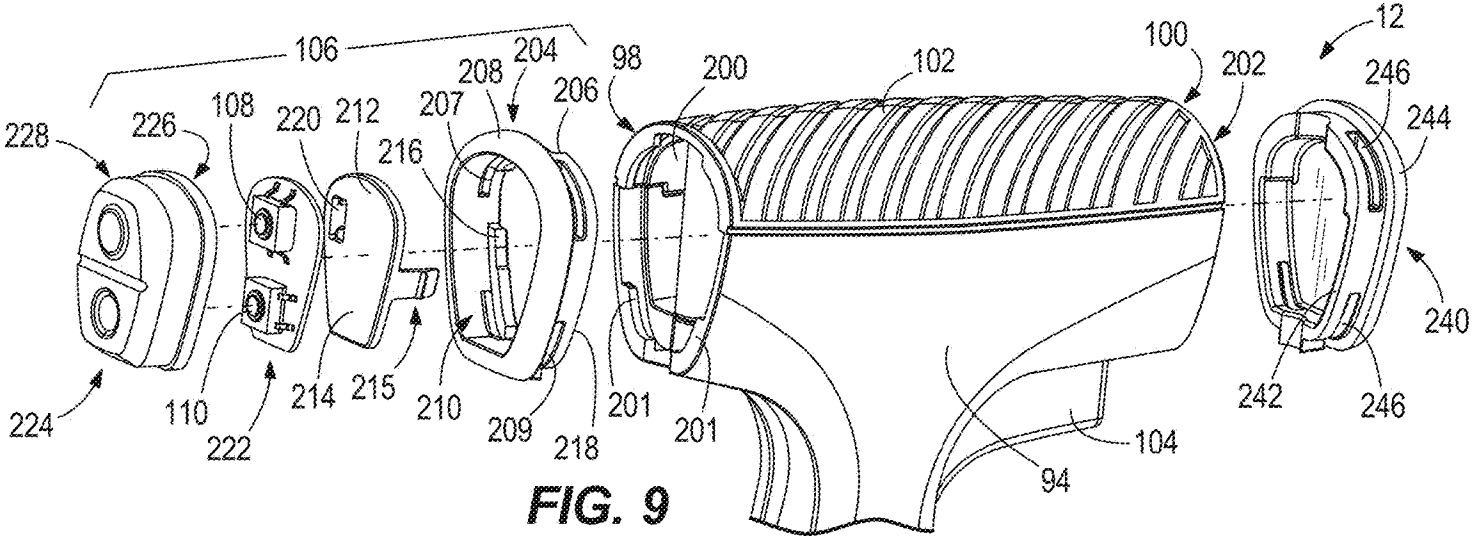
FIGS. 9 and 10 are exploded isometric views of the throttle lever of FIG. 1 in the first orientation and in a second origination, respectively.
Figure 10:
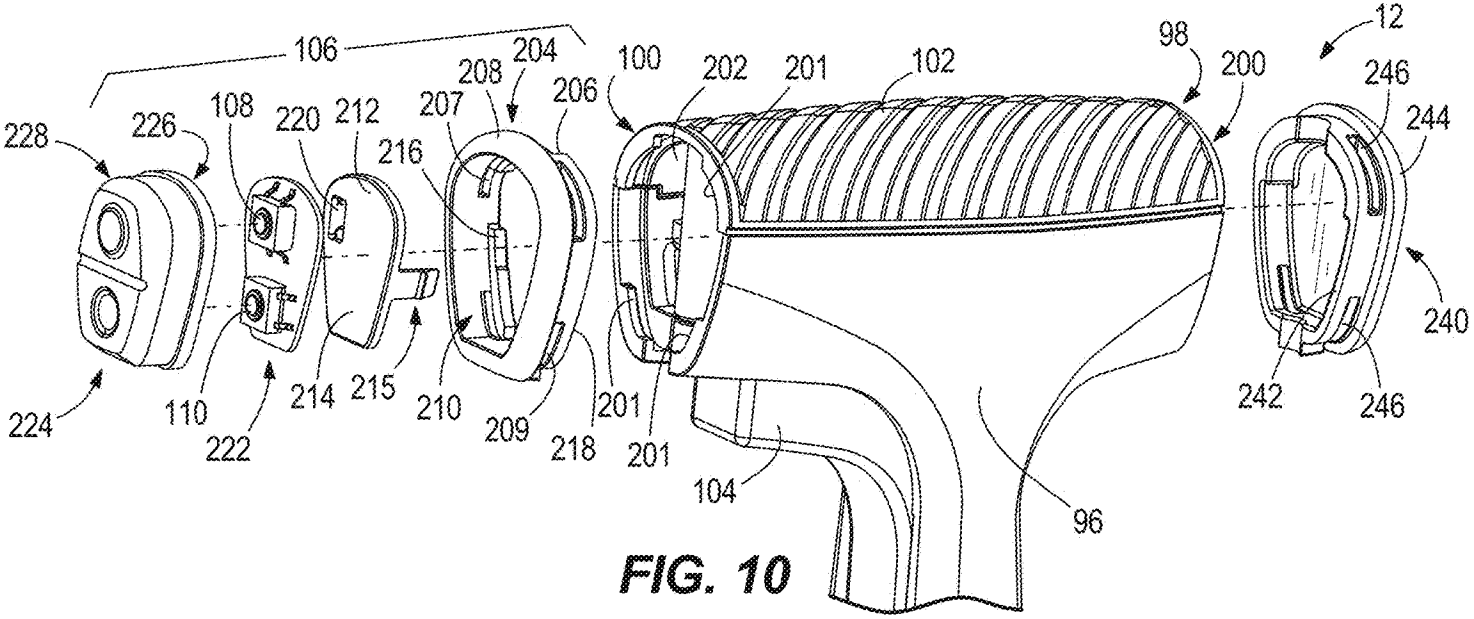

FIGS. 9 and 10 show the upper portion of the adaptable throttle unit 10 with the switch 106 being coupled to each of the inside 100 and the outside 98 of the handle 102, respectively. In particular, an opening 200 is provided in the outside 98 of the handle 102 and a like opening 202 is provided in the inside 100 of the handle 102. Each opening 200, 202 is configured to receive a collar 204 partially therein. The collar 204 includes a neck 206 that is positionable inside the handle 102, as well as a lip 208 configured to abut the inside 100 or outside 98 of the handle 102. Depressions 209 within the neck 206 receive projections 201 on an inner edge of the openings 200, 202 to retain the collar 204 against the handle 102, such as being snapped in place. Other mechanisms for retaining the collar 204 are also contemplated, including the use of fasteners or adhesives.

An opening 210 is formed within the collar 204, which is configured to receive a support base 212 therein. The support base 212 includes a surface 214 that abuts a shelf 216 extending inwardly into the opening 210 to control how far into the handle 102 the support base 212 is inserted. A clip 215 extends perpendicularly from the support base 212 and engages with an edge 218 of the neck 206 to retain the support base 212 within the collar 204 in a similar manner to how the collar 204 is retained within the openings 200, 202 in the handle 102.

An opening 220 extends through the support base 212 through which wires may pass from inside the handle 102 to a circuit board 222 positioned on the support base 212. The circuit board 222 includes the first button 108 and the second button 110 of the switch 106, which control the trim of the marine drive in a conventional manner (e.g., trim up and trim down, respectively). A resilient cover 224 is positioned over the circuit board 222 to prevent water ingress and other damage thereto. The cover 224 has an interior 226 that receives the circuit board 222 and the support base 212 at least partially therein. A lip 228 of the cover 224 extends outwardly so as to catch on an inward projection 207 extending into the opening 210 in the collar 204 to retain the cover 224 therewith. A first soft button 230 and a second soft button 232 align with the first button 108 and the second button 110 for actuation by the operator in a conventional manner.

It should be recognized that when the switch 106 is coupled within one of the openings 200, 202 of the handle 102, the other of the openings 200, 202 remains open and unused. A cap 240 is also provided, which has a neck 242 that is positionable inside the unused opening 200, 202 of the handle 102, as well as a lip 244 configured to abut the inside 100 or outside 98 of the handle 102. Depressions 246 within the neck 242 receive the projections 201 on the inner edge of the openings 200, 202 discussed above, which were also used to retain the collar 204 for the switch 106 against the handle 102. As with the switch 106, other mechanisms for retaining the collar 204 are also contemplated, including the use of fasteners or adhesives. The collar 204 and the cap 240 may comprise resilient materials that permit them to form water-tight seals with the handle 102. The present disclosure also contemplates the use of gaskets or other mechanisms for forming a seal to prevent debris and water ingress into the handle 102.

Figure 12:
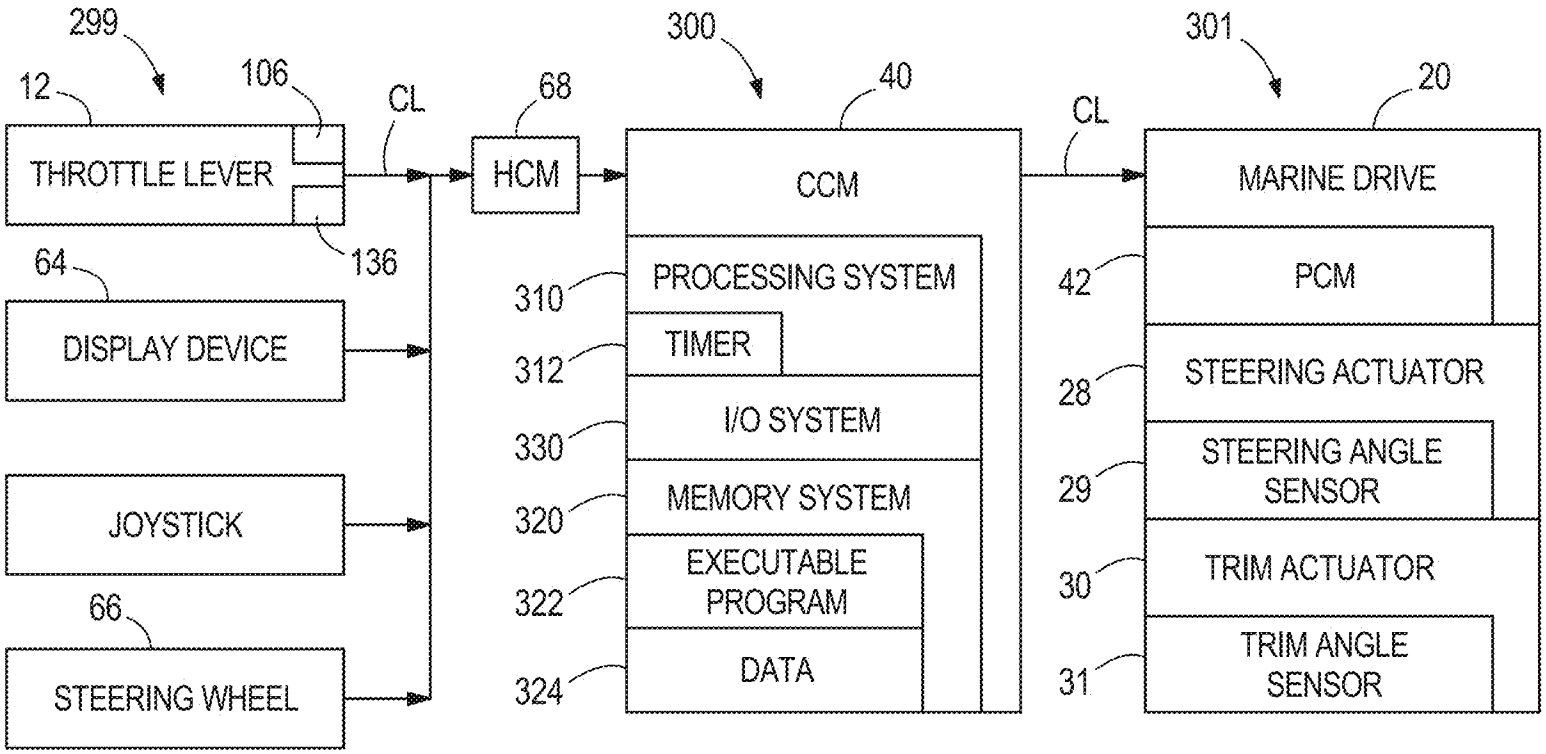
FIG. 12 is a schematic view of a control system according to the present disclosure for operating an adaptable throttle unit such as shown in FIG. 1.

Referring to FIG. 12, additional information is now provided for the subsystems within an exemplary control system 300 for operating the adaptable throttle unit in either the first orientation or the second orientation, and switching therebetween. The control system 300 includes one or more central control modules 40, one or more propulsion control modules 42, the helm control module 68, and/or other controllers. A person of ordinary skill in the art will recognize that these subsystems may also be present within additional central control modules 40 (as applicable) and/or propulsion control modules 42 or other controllers within the marine vessel. In the example shown, each central control module 40 includes a processing system 310, which may be implemented as a single microprocessor or other circuitry or be distributed across multiple processing devices or sub-systems that cooperate to execute the executable program 322 from the memory system 320. Non-limiting examples of the processing system include general purpose central processing units, application specific processors, and logic devices.

Each central control module 40 further includes a memory system 320, which may comprise any storage media readable by the processing system 310 and capable of storing the executable program 322 and/or data 324. The memory system 320 may be implemented as a single storage device or be distributed across multiple storage devices or subsystems that cooperate to store computer readable instructions, data structures, program modules, or other data. The memory system 320 may include volatile and/or non-volatile systems and may include removable and/or non-removable media implemented in any method or technology for storage of information. The storage media may include non-transitory and/or transitory storage media, including random access memory, read only memory, magnetic discs, optical discs, flash memory, virtual memory, and non-virtual memory, magnetic storage devices, or any other medium which can be used to store information and be accessed by an instruction execution system, for example. An input/output (I/O) system 330 provides communication between the control system 300 and peripheral devices, such as input devices 299 and output devices 301, which are discussed further below. In practice, the processing system 310 loads and executes an executable program 322 from the memory system 320, accesses data 324 stored within the memory system 320, and allows the adaptable throttle unit 10 to operate as described herein.

A person of ordinary skill in the art will recognize that these subsystems within the control system 300 may be implemented in hardware and/or software that carries out a programmed set of instructions. As used herein, the term "central control module" may refer to, be part of, or include an application specific integrated circuit (ASIC); an electronic circuit; a combinational logic circuit; a field programmable gate array (FPGA); a processor (shared, dedicated, or group) that executes code; other suitable components that provide the described functionality; or a combination of some or all of the above, such as in a system-on-chip (SoC). A central control module may include memory (shared, dedicated, or group) that stores code executed by the processing system. The term "code" may include software, firmware, and/or microcode, and may refer to programs, routines, functions, classes, and/or objects. The term "shared" means that some or all code from multiple central control modules may be executed using a single (shared) processor. In addition, some or all code from multiple central control modules may be stored by a single (shared) memory. The term "group" means that some or all code from a single central control module may be executed using a group of processors. In addition, some or all code from a single central control module may be stored using a group of memories. One or more central control module 40 may together constitute a control system 300. The one or more central control modules 40 can be located anywhere on the marine vessel 1.

A person of ordinary skill in the art will understand in light of the disclosure that the control system 300 may include a differing set of one or more control modules, or control devices, which may include engine control modules (ECMs) or propulsion control modules 42 for each marine drive 20 (which when applicable may be referred to as ECMs even if the marine drive 20 contains an electric motor in addition, to or in place of, an internal combustion engine), one or more thrust vector control modules (TVMs), one or more helm control modules (HCMs), and/or the like. Likewise, certain aspects of the present disclosure are described or depicted as functional and/or logical block components or processing steps, which may be performed by any number of hardware, software, and/or firmware components configured to perform the specified functions. For example, certain embodiments employ integrated circuit components, such as memory elements, digital signal processing elements, logic elements, look-up tables, or the like, configured to carry out a variety of functions under the control of one or more processors or other control devices.

With continued reference to FIG. 12, the control system 300 communicates with each of the one or more components of the marine vessel 1 via a communication link CL, which can be any wired or wireless link. The illustrated communication link CL connections between functional and logical block components are merely exemplary, which may be direct or indirect, and may follow alternate pathways. The control system 300 can receive information and/or controlling one or more operational characteristics of the marine vessel 1 and its various sub-systems by sending and receiving control signals via the communication links CL. In one example, the communication link CL is a controller area network (CAN) bus; however, other types of links could be used. It will be recognized that the extent of connections and the communication links CL may in fact be one or more shared connections, or links, among some or all of the components in the marine vessel 1. Moreover, the communication link CL lines are meant only to demonstrate that the various control elements can communicate with one another, and do not represent actual wiring connections between the various elements, nor do they represent the only paths of communication between the elements. Additionally, the marine vessel 1 may incorporate various types of communication devices and systems, and thus the illustrated communication links CL may in fact represent various different types of wireless and/or wired data communication systems.

As will be discussed further below, the control system 300 communicates with input devices 299 from various components such as the sensor 136 for measuring the rotational position of the throttle lever 12, the switch 106 that controls the trim of the marine drive 20, a steering angle sensor 29 that measures a steering angle in conjunction with the steering actuator 28, a trim angle sensor 31 that measure the trim angle, the steering wheel 66, a joystick, and/or other inputs. The control system 300 also communicates with other input devices, such as the multi-functional display device 64, the GPS 50, and/or the IMU/AHRS 52.

The control system 300 also communicates with output devices 301 such as the multi-functional display device 64 and other devices as the helm 60, propulsion control modules 42, steering actuators 28, and trim actuators 30. It will be recognized that the arrows shown in FIG. 12 are merely exemplary and that communication may flow in more than one direction and/or through different paths. By way of example, the steering angle sensors 29 and trim angle sensors 31, while shown as corresponding to the steering actuators 28 and trim actuators 30, may serve as separate input devices 99 feeding into the one or more central command modules 40.

With reference to FIGS. 1 and 12, the adaptable throttle unit 10 is configured such that the control system 300 can accommodate use in either the first orientation (FIG. 1) or the second orientation (FIG. 2), recognizing that the rotational direction of the throttle lever 12 changes between these two orientations. In particular, the control system 300 is configured such that the operator may use the multi-functional display device 64 to select whether the adaptable throttle unit 10 is installed in the marine vessel 1 in the first orientation, or in the second orientation. When the first orientation is selected, the control system 300 will interpret counterclockwise rotation of the throttle lever 12 away from neutral to correspond to a request for forward propulsion, and likewise reverse propulsion for clockwise rotation. When instead the second orientation is selected, the control system 300 reverses its interpretation of sensor inputs. Thus, counter-clockwise rotation of the throttle lever 12 away from neutral now corresponds to a request for reverse propulsion, and likewise forward propulsion for counter-clockwise rotation.

In this manner, the adaptable throttle unit 10 presently disclosed can be used for installation in two different orientations to accommodate for different types of marine vessels, including both panel mount and center console mount configurations. The same components are used in each configuration and the user can operator the throttle lever in the same manner in either orientation.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. An adaptable throttle unit for controlling a marine drive of a marine vessel, the adaptable throttle unit comprising:

a housing having a first side and an opposite second side, wherein the housing is coupleable to one portion of the marine vessel in a first orientation with the first side above the second side and to another portion of the marine vessel in a second orientation with the first side below the second side;

a throttle lever with an inside and an opposite outside each extending from a handle to a second end that is rotatably coupled to the housing, wherein the handle is above the second end and the inside faces the housing both when the housing is in the first orientation and in the second orientation, wherein each of the inside and the outside has an opening therein;

a switch configured to be coupled within the opening in the outside of the throttle lever when the housing is in the first orientation and within the opening in the inside of the throttle lever when the housing is in the second orientation;

a sensor configured to measure rotation of the throttle lever relative to the housing; and a controller operatively coupled to the sensor, wherein the controller is configured to request forward propulsion of the marine drive when the throttle lever is rotated in a first direction and the housing is in the first orientation, and alternately to request reverse propulsion of the marine drive when the throttle lever is rotated in the first direction when the housing is in the second orientation such that the adaptable throttle unit accommodates different configurations for the marine vessel.

2. The adaptable throttle unit according to claim 1, wherein the throttle lever is rotatable about an axis, and wherein the housing is rotated 180 degrees about the axis between the first orientation and the second orientation thereof.

3. The adaptable throttle unit according to claim 1, further comprising a cover configured to cover the opening in the inside of the throttle lever when the housing is in the first orientation and to cover the outside of the throttle lever when the housing is in the second orientation.

4. The adaptable throttle unit according to claim 1, wherein the switch is configured to receive a user input for controlling a trim of the marine drive, wherein the switch is operably coupled to the controller, and wherein the controller provides a request to adjust the trim of the marine drive according to the user input received via the switch.

5. The adaptable throttle unit according to claim 1, wherein the throttle lever is rotatable from a neutral position in the first direction and in the second direction, further comprising a lock that when engaged prevents rotation of the throttle lever out of the neutral position and a release button that disengages the lock, and wherein the release button is positioned on the inside of the throttle lever both when the housing is in the first orientation and in the second orientation.

6. The adaptable throttle unit according to claim 1, wherein the throttle lever is rotatable from a neutral position in the first direction and in the second direction, further comprising a first stop and a second stop that prevent the throttle lever from rotating beyond a first angle in the first direction and a second angle and in the second direction, respectively.

7. The adaptable throttle unit according to claim 6, wherein the first angle and the second angle are each between 60 and 80 degrees from the neutral position.

8. The adaptable throttle unit according to claim 6, wherein the first angle is equal to the second angle.

9. The adaptable throttle unit according to claim 1, wherein the housing is configured so as to be coupled to an inwardly facing wall of the marine vessel in the first position and coupled to a center console inward from the inwardly facing wall of the marine vessel in the second position.

10. The adaptable throttle unit according to claim 1, further comprising a key switch that controls whether the marine drive is operable to generate propulsion, wherein the key switch is positioned on a third side of the housing between the first side and the second side, and wherein the key switch is positioned aftwardly when the housing is coupled to the marine vessel in both the first orientation and the second orientation.

11. A method for installing a throttle unit for controlling a marine drive in a marine vessel, the method comprising:

determining whether to couple a housing of the throttle unit to the marine in a first orientation or in a second orientation;

coupling the housing to the marine vessel with a first side of the housing above an opposite second side of the housing when coupling the housing in the first orientation and with the first side below the second side in the second orientation;

rotatably coupling a throttle lever to the housing such that a handle of the throttle lever is above an opposite second end and such that an inside of the throttle lever extending between the handle and the second end faces the housing and an outside opposite the inside faces away from the housing both when the housing is in the first orientation and in the second orientation;

coupling a switch within an opening in the outside of the throttle lever when the housing is in the first orientation and alternately coupling the switch within an opening in the inside of the throttle lever when the housing is in the second orientation;

positioning a sensor so as to measure rotation of the throttle lever relative to the housing; and operatively coupling the sensor to a controller and configuring the controller to request forward propulsion of the marine drive when the sensor measures rotation of the throttle lever in a first direction and the housing is in the first orientation, and alternately to request reverse propulsion of the marine drive when the sensor measures rotation of the throttle lever in the first direction when the housing is in the second orientation such that the throttle unit accommodates different configurations for the marine vessel.

12. The method according to claim 11, wherein the opening in each of the inside and the outside of the throttle lever is in the handle, further comprising coupling a cover over the opening of the inside of the handle when the housing is in the first orientation and alternately over the opening of the outside of the handle when the housing is in the second orientation.

13. The method according to claim 11, wherein the throttle lever is rotatable from a neutral position in the first direction and in the second direction, further comprising positioning a lock within the throttle unit that when engaged prevents rotation of the throttle lever out of the neutral position, and further comprising configuring a release button to selectively disengage the lock, wherein the release button is positioned on the inside of the throttle lever both when the housing is in the first orientation and in the second orientation.

14. The method according to claim 11, wherein the throttle lever is rotatable from a neutral position in the first direction and in the second direction, further comprising positioning a first stop and a second stop within the throttle unit so as to prevent the throttle lever from rotating beyond a first angle in the first direction and a second angle and in the second direction, respectively.

15. The method according to claim 14, wherein the first angle and the second angle are substantially equal to each other.

16. An adaptable throttle unit for controlling a marine drive of a marine vessel, the adaptable throttle unit comprising:

a housing having a first side and an opposite second side, wherein the housing is coupleable to one portion of the marine vessel in a first orientation with the first side above the second side and to another portion of the marine vessel in a second orientation with the first side below the second side;

a throttle lever extending from a handle to an opposite second end rotatably coupled to the housing such that the handle is above the second end both when the housing is in the first orientation and in the second orientation, wherein the throttle lever has an inside and an opposite outside each extending between the first end and the second end, and wherein each of the inside and the outside has an opening, and wherein the inside faces the housing and the outside faces away from the housing both when the housing is in the first orientation and in the second orientation;

a first stop and a second stop that prevent the throttle lever from rotating beyond a first angle in the first direction and a second angle and in the second direction, respectively, wherein the first angle is substantially equal to the second angle;

a sensor configured to measure rotation of the throttle lever relative to the housing;

a switch configured to receive a user input for controlling a trim of the marine drive, wherein the switch is configured to be coupled within the opening of the outside of the throttle lever when the housing is in the first orientation and within the opening of the inside of the throttle lever when the housing is in the second orientation;

a cover configured to cover the opening of the inside of the throttle lever when the housing is in the first orientation and to cover the opening of the outside of the throttle lever when the housing is in the second orientation; and a controller operatively coupled to the switch and the sensor, wherein the controller is configured to provide a request to adjust the trim of the marine drive according to the user input received via the switch, and wherein the controller is configured to request forward propulsion of the marine drive when the sensor measures rotation of the throttle lever in a first direction and the housing is in the first orientation, and alternately to request reverse propulsion of the marine drive when the sensor measures rotation of the throttle lever in the first direction when the housing is in the second orientation such that the adaptable throttle unit accommodates different configurations for the marine vessel.

* * * * *